United States Patent [19]

Inoue

[11] Patent Number: 5,076,506

[45] Date of Patent: Dec. 31, 1991

[54] SEPARATOR FOR SEPARATING PROCESSED MATERIAL FROM GRINDING MEDIUM

[75] Inventor: Masakazu Inoue, Tokyo, Japan

[73] Assignee: Inoue Seisakusho (Mfg.) Co., Ltd., Japan

[21] Appl. No.: 149,843

[22] Filed: Jan. 29, 1988

[30] Foreign Application Priority Data

Jan. 30, 1987 [JP] Japan ..... 62-11458[U]

[51] Int. Cl.[5] ..... B02C 17/16

[52] U.S. Cl. ..... 241/171; 241/172

[58] Field of Search ..... 241/171, 172, 69; 209/233, 660

[56] References Cited

U.S. PATENT DOCUMENTS

| | | | |
|---|---|---|---|
| 3,486,705 | 12/1969 | Szegvari | 241/172 |
| 3,802,633 | 4/1974 | Schold | 241/172 X |
| 4,382,557 | 5/1983 | Duerr | 241/172 X |

FOREIGN PATENT DOCUMENTS

| | | | |
|---|---|---|---|
| 140656 | 3/1980 | German Democratic Rep. | 241/172 |
| 990299 | 2/1983 | U.S.S.R. | 241/172 |

*Primary Examiner*—Mark Rosenbaum

*Attorney, Agent, or Firm*—Bruce L. Adams; Van C. Wilks

[57] ABSTRACT

A dispersing and grinding apparatus disperses and grinds material by the use of a particulate grinding medium. A separator installed at the discharge end of the apparatus separates the processed material from the grinding medium. The separator comprises a stationary stator, and a rotatable rotor mounted so that the rim area of the rotor is spaced from and faces the stator to define therebetween a small gap which is large enough to permit the processed material to pass therethrough small enough to prevent the grinding medium from passing therethrough. The rotor has on its underside a plurality of protruding guide portions configured as arc-shaped protrusions which forcibly guide and disperse the grinding medium tending to collect and concentrate at the rim area of the rotor. By such a construction, the useful life of the rotor is significantly prolonged because the grinding medium is positively and forcibly guided radially outwardly away from the confronting surfaces of the rotor and stator thereby minimizing wear of the rotor and stator surfaces.

24 Claims, 1 Drawing Sheet

SEPARATOR FOR SEPARATING PROCESSED MATERIAL FROM GRINDING MEDIUM

BACKGROUND OF THE INVENTION (1) Field of the Invention

The present invention relates generally to separators for separating processed material from a grinding medium in a dispersing and grinding apparatus and more particularly, to a separator having guiding means for forcibly guiding and displacing the grinding medium away from the region where the separated processed material exits from the apparatus.

(2) Background Information

Dispersing and grinding apparatus are in widespread use for dispersing, grinding and agitating various types of materials. These apparatus are commonly known as dispersion agitators or grinding mills and utilize a grinding medium, such as balls, beads or other particulates to accomplish the grinding and comminuting action. After the material is suitably dispersed, ground and agitated, the processed material must be separated from the grinding medium. For this purpose, a separator is frequently installed at the discharge end of the apparatus for separating the processed material from the grinding medium such that the processed material is discharged from the apparatus while the grinding medium is retained in the apparatus for re-use.

One common type of separator is the so-called dynamic separator which comprises a stationary stator and a rotatable rotor. The stator and rotor are spaced apart a slight distance so that a small gap exists between the rim of the rotor and the stator to define a discharge passage for the processed material. The size of the gap is smaller than the size of the particulates which constitute the grinding medium thereby ensuring that the grinding medium cannot pass through the gap.

One drawback of such separators is that the stator, the rotor, or both, become quickly abraded by the grinding medium and, therefore, need frequent replacement. This is due to the fact that the grinding medium tends to accumulate and concentrate at the rim area of the rotor so that as the rotor rotates, the grinding medium gets carried along with the rotating rotor and abrades and wears out the confronting surfaces of the stator and rotor.

Various attempts have been made to solve this problem, though none has proved satisfactory. For example, it has been proposed to configure the rotor in an elliptical shape to reduce the concentration of the grinding medium at the rim area of the rotor. It has also been proposed to mount the rotor eccentrically relative to the stator so that as the rotor rotates, the relative positions of the rim area of the rotor and the stator constantly change so as to avoid the concentration of the grinding medium at the rim area of the rotor. These prior art attempts are disclosed, for example, in U.S. Pat. No. 4,534,516. However, these prior art separators do not prevent rapid wearing out of the rotor because the periphery of the rotor itself is used to push the grindind medium outwardly. Hence, the rotor rapidly becomes worn and requires frequent replacement. Moreover, when it becomes necessary to replace the rotor in the prior art separators, it is usually necessary to remove and replace the entire rotor assembly, and such a task is both troublesome and uneconomical.

SUMMARY OF THE INVENTION

One object of the present invention is to provide a separator for separating processed material from a grinding medium in a dispersing and grinding apparatus and which forcibly guides the grinding medium away from the region where the separated processed material exits from the apparatus.

Another object of the present invention is to provide a separator comprised of a stator and rotor and which has guiding means on the rotor for forcibly guiding the grinding medium radially outwardly away from the rim area of the rotor thereby minimizing wear of the rotor and stator.

A further object of the present invention is to provide a separator comprised of a stator and rotor and which has protruding guide portions attached to the underside of the rotor for forcibly guiding the grinding medium radially outwardly away from the rim area of the rotor thereby minimizing wear of the rotor and stator.

A still further object of the present invention is to provide a separator which is rugged and durable in construction and which has a longer useful life than comparable prior art separators.

These as well as other objects, features and advantages of the invention are achieved by a separator comprised of a stationary stator, and a rotor mounted so that the rim area of the rotor is spaced from and faces the stator to define therebetween a small gap which is large enough to permit the processed material to pass therethrough though which is small enough to prevent the grinding medium from passing therethrough. The rotor is provided on its underside with a plurality of protruding guide portions which extend downwardly from the rotor and which effectively forcibly guide and disperse the grinding medium which tends to collect and concentrate at the rim area of the rotor. By such a construction, the useful life of the rotor and stator is significantly prolonged because the grinding medium is positively and forcibly guided away from the confronting surfaces of the rotor and stator by the protruding guide portions.

The aforementioned objects, features and advantages of the present invention, as well as others, will become more readily apparent to persons of ordinary skill in the art upon a reading of the following description of the invention when read in conjunction with the accompanying drawings.

DESCRIPTION OF THE PREFERRED EMBODIMENT

The separator of the present invention may be used with either a horizontal- or vertical-type dispersing and grinding apparatus. In the following description reference will be made to the vertical-type apparatus, and it is understood that the separator of the invention is equally applicable for use with a horizontal-type dispersing and grinding apparatus.

Figure 1:
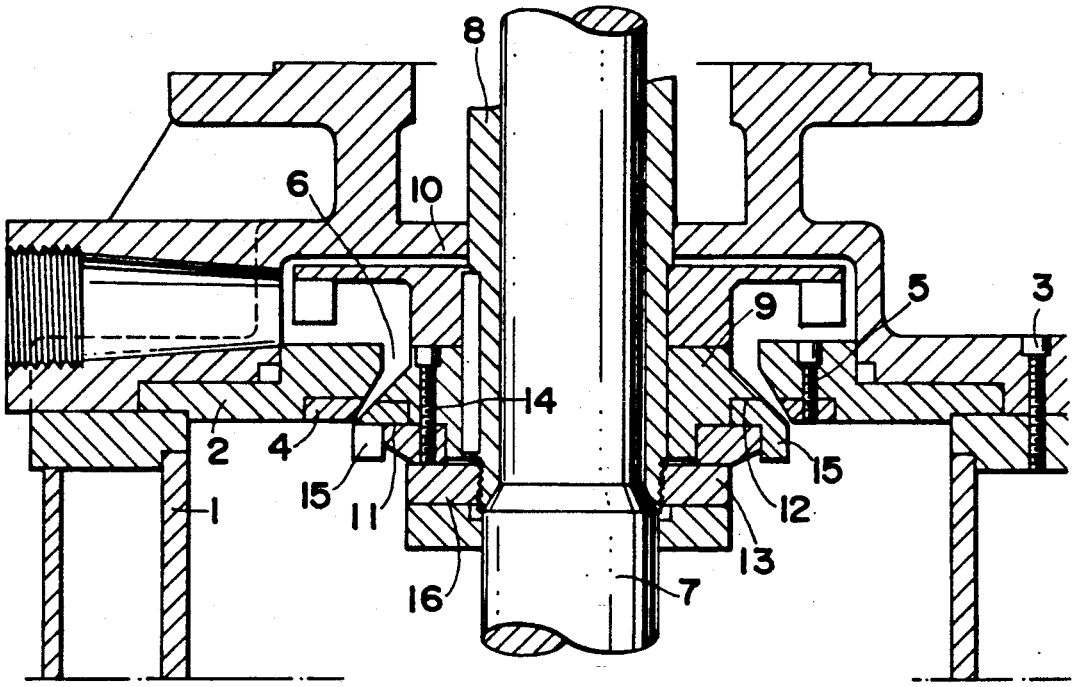
FIG. 1 is a longitudinal sectional view of a separator for separating processed material from a grinding medium constructed according to the principles of the present invention.

FIG. 1 shows one embodiment of a separator installed in a vertical-type dispersing and grinding apparatus. The apparatus includes a vertically disposed grinding vessel 1 which contains means (not shown) for admitting a material to be processed. Also contained within the grinding vessel 1 is a grinding medium (not shown) which may comprise balls, beads, or other suitable particulates. The particular grinding medium does not constitute part of the present invention, and its choice will depend on the nature of the material being processed and the kind of processing to be done. An agitator (not shown) is rotatably disposed within the grinding vessel 1 and functions in a manner well known in the art to disperse, grind and agitate the material by the cooperative actions of the rotating agitator and the grinding medium. As the agitator rotates, the material contained within the grinding vessel 1 is uniformly mixed, dispersed and ground by the grinding medium, and the thus processed material is progressively advanced upwardly toward the upper end of the grinding vessel 1.

The separator is installed at the upper portion of the grinding vessel 1 and comprises a stationary stator assembly and a rotatable rotor assembly. The stator assembly comprises a flange 2 removably attached to the grinding vessel 1 by means of fastening bolts 3. The flange 2 is provided with an annular recess, and an annular, ring-shaped stator 4 is disposed within the flange recess and removably secured to the flange 2 by fastening bolts 5.

The inner peripheries of the flange 2 and the stator 4 are inclined outwardly in the downward direction and define an outlet 6 for the discharge of the processed material from the grinding vessel 1. A rotary shaft 7 extends through the outlet 6 downwardly into the grinding vessel 1 and carries the agitator (now shown). During use of the apparatus, the rotary shaft 7 is rotationally driven by means (now shown) to accordingly rotate the agitator which disperses, grinds and agitates the material within the grinding vessel 1 in conjunction with the grinding medium.

The rotor assembly comprises a support member 9 which is removably secured to the rotary shaft 7 to undergo rotation therewith by means of a key-and-groove connection. The key-and-groove connection comprises a sleeve 8 secured to the rotary shaft 7, and a key 10 inserted into a pair of opposed grooves formed in the sleeve 8 and the support member 9. In this manner, the rotation of the rotary shaft 7 is transmitted through the keyed connection to the support member 9. An annular recess 12 is formed around the periphery of the support member 9, and a rotor 11 of generally circular shape is mounted in the recess 12 and extends radially outwardly of the support member 9. The radial outer peripheries of the support member 9 and the rotor 11 are inclined outwardly in the downward direction and coact with the inclined radial inner peripheries of the flange 2 and the stator 4 to define therebetween a gap for the discharge of the processed material. A back plate 13 is provided on the underside of the support member 9 and engages with the underside of the rotor 11 to secure the rotor 11 to the support member 9. A set of fastening bolts 14 are used to fasten together the support member 9, the rotor 11 and the back plate 13 to thereby define the rotor assembly. A threaded nut 16 is threaded onto the lower end of the sleeve 8 in order to set and maintain the axial position of the rotor assembly relative to the rotary shaft 7.

Figure 2:
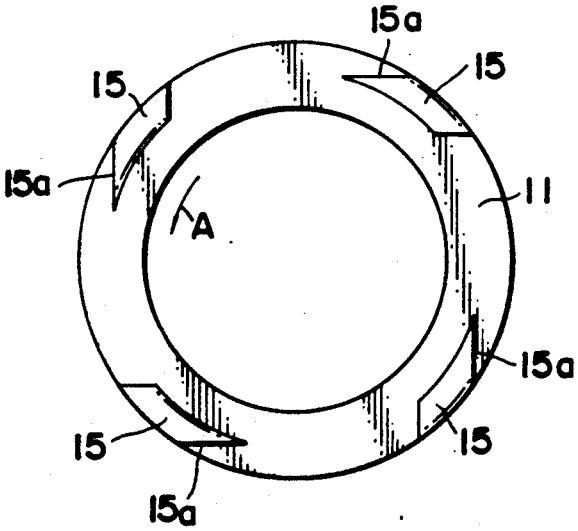
FIG. 2 is a bottom plan view of the rotor shown in FIG. 1.
Figure 3:
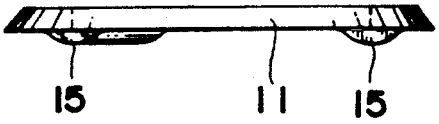
FIG. 3 is a side view of the rotor shown in FIG. 2.

The rotor 11 is provided with guiding means 15 for forcibly guiding and dispersing the grinding medium radially outwardly away from the periphery of the rotor 11. In this embodiment, the guiding means comprises a plurality of protruding guide portions or protrusions 15 which protrude downwardly from the underside of the rotor 11 and which are circumferentially spaced apart around the periphery of the rotor. As shown in FIGS. 2 and 3, each protruding guide portion 15 has an arc-shaped configuration which is concaved outwardly relative to the underside of the rotor 11. The opposite ends of the protruding guide portions 15 are flat and extend obliquely inwardly from the periphery of the rotor 11.

FIG. 2, which is a bottom plan view of the rotor 11, shows the configuration of the protruding guide portions 15 in the case where the rotor 11 is designed to rotate in the counterclockwise direction as denoted by arrow A. The leading ends 15*a* of the protruding guide portions 15 are oriented relative to the direction of rotation of the rotor 11 so as to exert an outward pushing force on the grinding medium as the rotor 11 rotates in the direction of arrow A. By such a construction, the guiding means 15 forcibly guides and displaces the grinding medium radially outwardly away from the confronting peripheral surfaces of the stator 4 and the rotor 11 thereby greatly reducing the wearing and abrading of the stator and rotor which would otherwise occur if the guiding means were eliminated.

In the embodiment shown in the drawings, the rotor 11 is provided with four protruding guide portions or protrusions 15 which are circumferentially spaced apart around the periphery of the rotor. The present invention is not limited to the use of four such protruding guide portions 15, and the number of protruding guide portions may be more or less than four. Further, in the disclosed embodiment, the protruding guide portions 15 are formed integrally with the rotor 11 as a one-piece unitary structure. If desired, the protruding guide portions 15 may be formed as separate pieces removably attached to the rotor 11 by bolts or other suitable fastening means.

Figure 4:
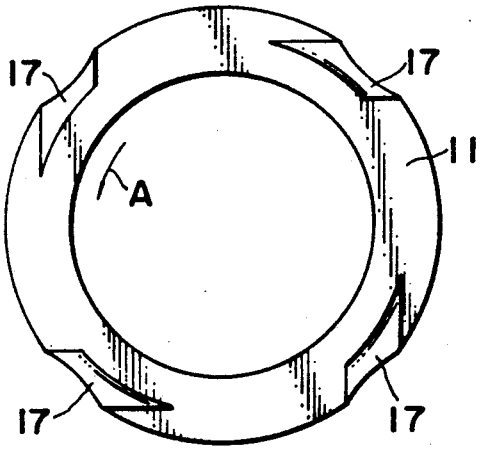
FIG. 4 is a bottom plan view of another embodiment of rotor.

The guide portions on the rotor 11 may be formed in configurations other than the arc-shaped configuration shown in the drawings. For example, as shown in the embodiment of FIG. 4, the guide portions are in the form of recessed portions or grooves 17 concaved inwardly in the radial direction of the rotor 11 and extending circumferentially thereof so that the grinding medium can flow into the concavity 17 and then be forcibly guided radially outwardly by the pushing action exerted by the trailing concave surface during rotation of the rotor.

As shown in FIG. 1, when the separator is installed on a dispersing and grinding apparatus, the inclined radial peripheral surface portion of the rotor 11 is laterally spaced from and faces the inclined radial peripheral surface portion of the stator 4 to define a small gap between the rotor 11 and the stator 4. The small gap is suitably dimensioned to permit the processed material to flow therethrough and be discharged from the grinding vessel 1 but is too small to permit the passage therethrough of the grinding medium. The gap spacing may be selectively varied, depending on the size of the particular grinding medium, by adjusting the axial position of the rotor assembly relative to the stator assembly.

When the relative positions of the stator 4 and the rotor 11 are selected and set, the gap spacing will be small enough to prevent the grinding medium to pass therethrough so that only the processed material will exit through the gap and be discharged through the outlet 6.

During operation of the dispersing and grinding apparatus, a material to be processed and a suitable grinding medium are charged into the grinding vessel 1. The rotary shaft 7 is rotationally driven to rotate the agitator to disperse, grind and agitate the material by the cooperative actions of the agitator and the grinding medium. As the processing progresses, processed material passes through the small gap between the stator 4 and the rotor 11 and exits the grinding vessel 1 whereas the grinding medium is too large to pass through the gap and remains in the grinding vessel 1. In this manner, the separator effectively separates the processed material from the grinding medium.

During the processing and discharging of the processed material, the processed material and the grinding medium progressively advance to the upper end of the grinding vessel 1. The processed material exits through the small gap whereas the grinding medium tends to collect and concentrate at the rim area of the rotor 11. If the grinding medium were not continually removed from the rim area of the rotor, the grinding medium would rapidly abrade the surfaces of the stator 4 and the rotor 11 thereby rapidly wearing out the stator and rotor. The guiding means 15 effectively prevents this problem by forcibly guiding and dispersing the grinding medium radially outwardly away from the rim area of the rotor 11.

According to the invention, the protruding guide portions 15 are carried by the rotor 11 so that as the rotor 11 rotates, the protruding guide portions 15 likewise rotate and forcibly guide and disperse the grinding medium away from the confronting peripheral surface portions of the stator 4 and the rotor 11. The protruding guide portions 15 exert an outward pushing force on the grinding medium located in the region of the rim area of the rotor 11 to thereby forcibly disperse the grinding medium radially outwardly. As the grinding medium is pushed radially outwardly by the rotating guide portions 15, the radially moving grinding medium collides with the upwardly moving grinding medium which approaches the small gap and pushes the latter further outwardly away from the stator 4 and rotor 11. By such a construction, the grinding medium is prevented from accumulating and concentrating at the rim area of the rotor thereby greatly diminishing the abrading of the rotor and stator surfaces and greatly prolonging the useful life of the separator.

Obvious modifications and changes can be made to the embodiment described above without departing from the spirit and scope of the invention. For example, the rotor assembly can be connected directly to the rotary shaft 7, if desired, without using the sleeve 8. Fastening means other than bolts can be used to releasably fasten and connect together the parts of the rotor and stator assemblies.

As described above, the separator of the present invention greatly prolongs the useful life of the stator and rotor by effectively preventing an accumulation and concentration of the grinding medium in the vicinity of the stator and rotor. This is achieved by providing protruding guide portions on the rotor to forcibly guide and disperse the grinding medium radially outwardly away from the confronting surfaces of the stator and rotor. The separator of the invention is, therefore, more economical to operate and more simple to maintain and service than comparable prior art separators.

What is claimed is:

1. A separator for use with a dispersing and grinding apparatus of the type which disperses and grinds material by means of a grinding medium, separates the processed material from the grinding medium and discharges the processed material, the separator comprising: a stationary stator having a radial peripheral surface portion; a rotatable rotor having a radial peripheral surface portion; means for rotatably mounting the rotor such that the radial peripheral surface portion of the rotor is radially spaced from and faces the radial peripheral surface portion of the stator to define a small gap therebetween for the discharge of processed material; and guiding means on the underside of the rotor adjacent the radial peripheral surface of the rotor for forcibly guiding the grinding medium radially outwardly away from the radial peripheral surface portion of the rotor during rotation of the rotor during use of the separator, the guiding means being flush with the outer periphery of the rotor.

2. A separator according to claim 1; wherein the guiding means comprises a plurality of circumferentially spaced-apart guide portions provided on the periphery of the rotor.

3. A separator according to claim 2; wherein the guide portions comprise protruding guide portions protruding downwardly from the rotor.

4. A separator according to claim 3; wherein the protruding guide portions are flush with the outer periphery of the rotor.

5. A separator according to claim 3; wherein the protruding guide portions have an arc-shaped configuration which is concaved outwardly relative to the rotor.

6. A separator according to claim 3; wherein the protruding guide portions have leading ends with respect to the direction of rotation of the rotor, the leading ends being configured to exert an outward pushing force on the grinding medium effective to forcibly displace the grinding medium radially outwardly away from the radial peripheral surface portion of the rotor during rotation of the rotor.

7. A separator according to claim 2; wherein the guide portions have a concave configuration.

8. A separator according to claim 7; wherein the concave configuration of the guide portions is configured to exert an outward pushing force on the grinding medium in the vicinity of the rotor periphery effective to forcibly displace the grinding medium radially outwardly away from the radial peripheral surface portion of the rotor during rotation of the rotor.

9. A separator according to claim 8; wherein the concavely configured guide portions comprise concave grooves in the periphery of the rotor.

10. A separator according to claim 8; wherein the concavely configured guide portions comprise concave protrusions on the periphery of the rotor, the concave protrusions being concaved outwardly relative to the rotor.

11. A separator according to claim 2; wherein the means for rotatably mounting the rotor comprises means for rotatably mounting the rotor such that the facing radial peripheral surface portions of the rotor and stator are laterally spaced apart and laterally confront one another.

12. A separator according to claim 11; wherein the laterally confronting peripheral surface portions of the rotor and stator are each inclined with respect to the axis of rotation of the rotor and define therebetween the small gap.

13. A separator according to claim 12; wherein the guide portions comprise protruding guide portions protruding downwardly from the rotor and lying flush with the outer periphery of the rotor.

14. A separator according to claim 12; wherein the rotor comprises a disc-shaped rotor having an inclined outer peripheral side which comprises the radial peripheral surface portion of the rotor.

15. An apparatus according to claim 1; including means removably connecting the rotor to the separator to enable removal and replacement of the rotor.

16. An apparatus according to claim 1; including means removably connecting the stator to the separator to enable removal and replacement of the stator.

17. In a dispersing and grinding apparatus having a vessel in which a grinding medium disperses and grinds a material to produce processed material: a separator connected to the vessel for separating the processed material from the grinding medium and effecting discharge of the processed material from the vessel, the separator comprising a stationary stator having a radial peripheral surface portion, a rotatable rotor having a radial peripheral surface portion, means for rotatably mounting the rotor such that the radial peripheral surface portion of the rotor is radially spaced from and faces the radial peripheral surface portion of the stator to define a small gap therebetween for the discharge of processed material, and guiding means on the underside of the rotor adjacent the radial peripheral surface of the rotor for forcibly guiding the grinding medium radially outwardly away from the radial peripheral surface portion of the rotor during rotation of the rotor during use of the apparatus, the guiding means being flush with the outer periphery of the rotor.

18. An apparatus according to claim 17; wherein the guiding means comprises a plurality of circumferentially spaced-apart guide portions provided on the periphery of the rotor.

19. An apparatus according to claim 18; wherein the guide portions have a concave configuration.

20. An apparatus according to claim 19; wherein the concave configuration of the guide portions is configured to exert an outward pushing force on the grinding medium in the vicinity of the rotor periphery effective to forcibly displace the grinding medium radially outwardly away from the radial peripheral surface portion of the rotor during rotation of the rotor.

21. An apparatus according to claim 20; wherein the concavely configured guide portions comprise concave grooves in the periphery of the rotor.

22. An apparatus according to claim 20; wherein the concavely configured guide portions comprise concave protrusions on the periphery of the rotor, the concave protrusions being concaved outwardly relative to the rotor.

23. An apparatus according to claim 17; including means removably connecting the rotor to the separator to enable removal and replacement of the rotor.

24. An apparatus according to claim 17; including means removably connecting the stator to the separator to enable removal and replacement of the stator.

* * * * *